US005666899A

United States Patent [19]

Andersen

[11] Patent Number: 5,666,899

[45] Date of Patent: Sep. 16, 1997

[54] BOAT ANCHOR RETRIEVAL SYSTEM AND APPARATUS

[76] Inventor: Rick E. Andersen, 2713 Whitman Ave., Vancouver, Wash. 98662

[21] Appl. No.: 497,902

[22] Filed: Jul. 3, 1995

[51] Int. Cl.[6] ..... B63B 21/24

[52] U.S. Cl. ..... 114/297; 24/129 R; 114/299

[58] Field of Search ..... 114/297, 299, 114/51; 24/129 R, 129 A, 908, 607

[56] References Cited

U.S. PATENT DOCUMENTS

| | | | |
|---|---|---|---|
| 3,094,095 | 6/1963 | Litchfield et al. . | |
| 3,913,514 | 10/1975 | Reynolds . | |
| 4,067,287 | 1/1978 | Sabella . | |
| 4,161,922 | 7/1979 | Fogg . | |
| 4,414,712 | 11/1983 | Beggins | 114/218 |

FOREIGN PATENT DOCUMENTS 62-8885 1/1987 Japan .

*Primary Examiner*—Sherman Basinger

*Attorney, Agent, or Firm*—Klarquist Sparkman Campbell Leigh & Whinston

[57] ABSTRACT

A float catch for a boat anchoring and retrieval system includes a body with a head section and a tail section, the body being secured to an anchor line. The head section defines an anchor rope passageway through which an anchor line passes and is engaged by a rope diverter which spreads the anchor line away from the tail section of the float catch. Consequently, when the anchor is retrieved, the rope and float catch slide relative to the float in one direction until the float is coupled to the rope at a position between the float catch and the anchor. The tail section of the float catch thereafter prevents relative travel of the float past the float catch in the opposite direction during retrieval of the anchor.

17 Claims, 4 Drawing Sheets

10
26
28
30
22
16
20
40
45
41
14
12
18

22
26
TO BOAT
28
30
16
40
20
45
41
14
12

BOAT ANCHOR RETRIEVAL SYSTEM AND APPARATUS

The present invention concerns the retrieval of deployed anchors and more particularly utilizes a float to assist in lifting and supporting an anchor during retrieval.

A number of float assisted anchor raising devices are known. For example, in U.S. Pat. No. 4,067,287 to Sabella, a float is coupled to a hinged tubular housing. After the anchor is deployed, the tubular housing is opened to receive an anchor rope and then closed around the rope. A hinged flapper plate permits one-way travel of the rope through the tubular device. To retrieve the anchor, a boat is driven to pull the anchor rope through the tubular device and raise the anchor. The float supports the anchor after it has been raised with the flapper plate preventing the anchor from redeploying as the anchor line and raised anchor is pulled into the boat.

U.S. Pat. No. 3,094,095 to Litchfield et al. discloses another float assisted anchor raising device in which a float is slidably coupled to an anchor line by a coil. To retrieve a deployed anchor, the boat is driven to cause the coil to slide relative to the rope and over the anchor shaft, with the float assisting in raising the anchor.

U.S. Pat. No. 4,161,922 to Fogg illustrates another form of float assisted anchor retrieval device. In Fogg, an anchor line is engaged by a pawl to prevent the anchor from redeploying after a boat has pulled the anchor line, in the direction permitted by the pawl, to raise the anchor. The anchor is supported by a float in this raised position. Japanese Patent No. 62-8885 illustrates what appears to be another float assisted anchoring device with a one-way rope passing mechanism which prevents the rope and anchor from redeploying after an anchor has been raised.

Finally, U.S. Pat. No. 3,913,514 to Reynolds discloses a two-piece hook through which a rope passes, the two-pieces being threaded together. A knot is formed in the rope .and positioned inside at least one of the two pieces to hold the hook at a desired location along the rope. During anchor retrieval, an anchor snap fastener coupled to a float slides relative to the rope and past the hook. Back travel of the float along the anchor line and toward the boat is prevented by the hook.

Although these devices exist, a need exists for an improved boat anchoring and anchor retrieval system and apparatus.

SUMMARY OF THE INVENTION

In accordance with the present invention, a float catch is provided for a boat anchoring and anchor retrieval system. The system is of the type in which a deployed anchor is attached to the boat by an anchor line and in which a float is slidably coupled to the anchor line to permit the anchor line to slide relative to the float as the anchor is retrieved. Typically, the anchor line is retrieved by powering the boat so as to draw the anchor line in a direction which shifts the float along the line and toward the anchor.

The float catch comprises a body with head and tail sections, with the head section defining an anchor rope passageway. The body includes a rope diverter positioned to engage an anchor rope passing through the anchor rope passageway. The rope diverter is shaped so as to divert the engaged rope in a direction away from the tail section. Consequently, as the anchor is retrieved, the rope and float catch slide relative to the float in one direction until the float is coupled to the rope at a position between the float catch and the anchor. The tail section of the float catch thereafter prevents relative travel of the float past the float catch in the opposite direction during retrieval of the anchor. The float is buoyant enough to support the anchor in the retrieved position. Consequently, the operator of the boat can simply pull in the slack anchor line to bring the float and raised anchor adjacent to the boat. The float can simply be detached from the line, for example utilizing a snap fastener for this purpose, and stowed in the boat while the user holds onto the anchor line. The anchor is then hoisted on board. Consequently, the float and powered boat do most of the work in raising the anchor from the bottom of a river, lake, reservoir, or other body of water, without the need for power winches or other expensive, complex equipment.

In its most preferred form, the float catch is of a unitary, one-piece construction. The float catch may be made of any suitable material but is typically made of a plastic which can be readily molded to inexpensively mass produce float catches.

Although the anchor rope passageway need not be totally enclosed, in a preferred form of the invention, the head section of the body defines the anchor rope passageway in a manner such that the head section surrounds the passageway.

As a more specific aspect of one embodiment of the present invention, the passageway has a longitudinal axis. In addition, in accordance with this aspect, the rope diverter is positioned between the head section and tail section of the body and projects into the path of an extension of the longitudinal axis toward the rope diverter. Consequently, the diverter directs the rope in a direction away from the tail section and, in effect, spreads the rope. This minimizes the risk of the float backtracking along the anchor line past the float catch and toward the boat after the anchor has been lifted from the bottom.

In a specific embodiment, the rope diverter includes a rope engagement surface which is at an acute angle relative to the longitudinal axis of the passageway. Furthermore, in a specific alternative form of diverter, the engagement surface is sloped in a transverse direction relative to the longitudinal axis of the passageway to further direct the rope away from the tail section of the float catch.

The rope diverter may further comprise a diverter ramp which projects into the pathway of rope passing through the rope passageway to thus urge the rope away from the tail section of a float catch.

As another aspect of an embodiment of the present invention, the head section may include a ramp portion which projects in the same direction as the diverter ramp. The ramp portion assists in directing a fastener, which couples the float to the anchor line, over the top of the diverter ramp as the anchor line is retrieved. This reduces the risk of the fastener hanging up on the diverter ramp.

As a specific optional feature, the head section of the float catch may include a tapered or cutout nose portion which facilitates the passage of a float fastener over the float catch during retrieval of an anchor.

As a more specific aspect of an embodiment of the present invention, the body is elongated and generally straight. In addition, the diverter ramp is positioned between the head section and tail section and projects outwardly in a first direction and into a straight line extension of the passageway from the head section toward the tail section.

As yet another aspect of the present invention, the head section may also include an opening through which a mechanical boat fastener is received to secure the float catch to the rope at a fixed position along the rope.

The present invention also relates to a boat anchoring and anchor retrieval system including a float, an anchor rope, an anchor and an improved float catch.

It is accordingly an object of the present invention to provide an improved anchoring and anchor retrieval system utilizing a float and improved float catch.

These and other objects, features and advantages of the present invention will become more apparent with reference to the drawings and description.

DETAILED DESCRIPTION OF PREFERRED EMBODIMENTS

Figures 1, 2:
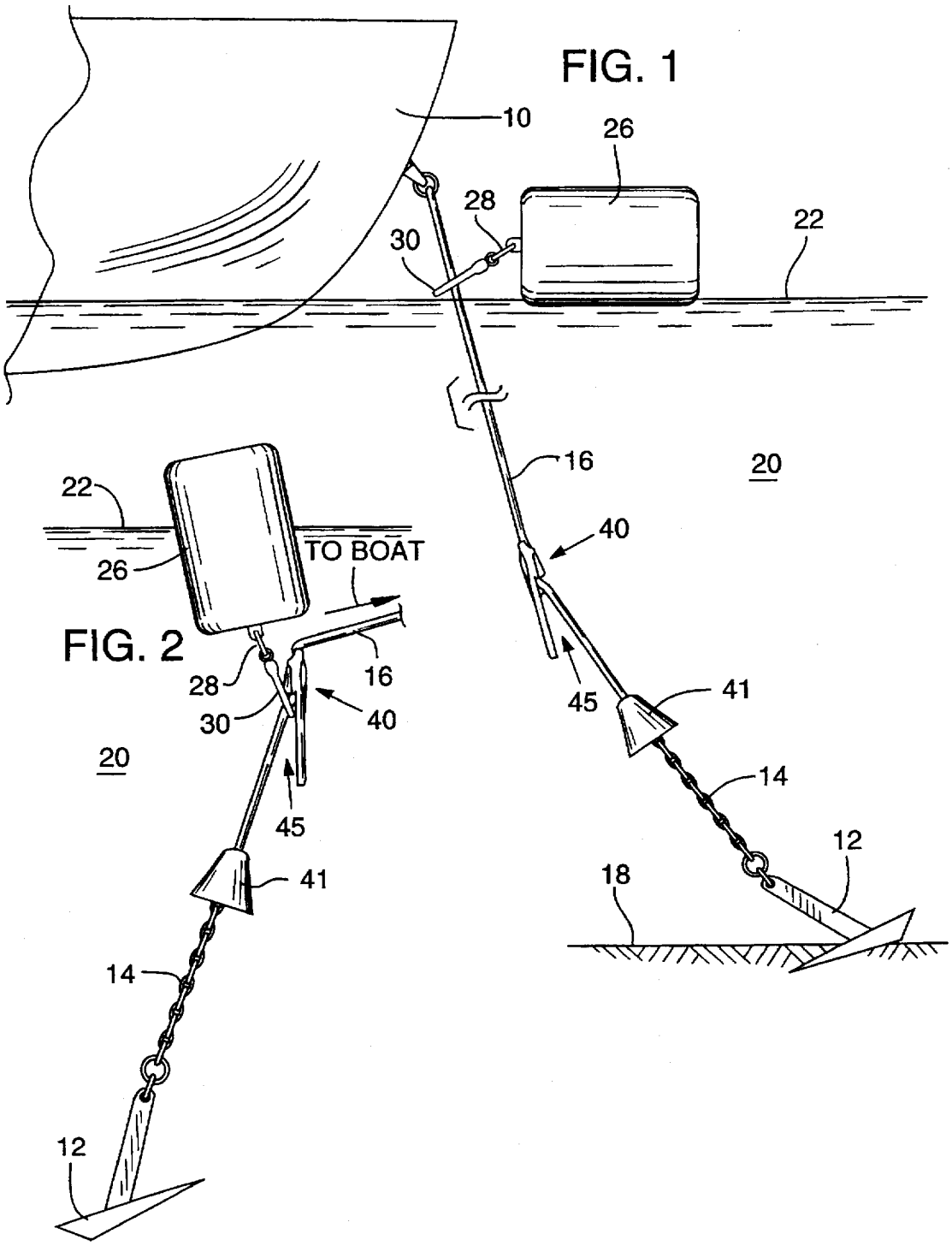
FIG. 1 is a perspective illustration of an anchoring system with a float catch in accordance with a first embodiment of the present invention showing a deployed anchor.
FIG. 2 is an illustration of the embodiment of FIG. 1 showing the anchor in a retrieved position and supported by a float.

With reference to FIG. 1, a boat 10 is shown anchored by an anchor 12 coupled by an anchor chain 14 and anchor line 16 to the boat. In a conventional manner, anchor 12 is shown engaging the bottom 18 of a lake, river, reservoir, or other body of water 20 having a surface indicated schematically by surface line 22.

A float 26 is shown coupled by a slide fastener 30 to the anchor line 16 with the float buoyantly supported at the water surface 22. Typically, the anchor is deployed fully without the float. The float is then simply snapped onto the deployed anchor line with a conventional snap fastener 30 typically being utilized for this purpose. The float 26 may be of any convenient shape and provides sufficient buoyancy to support the anchor when the anchor is raised off of the bottom 18. The illustrated float 26 is a commercially available five-gallon container of plastic or other lightweight material.

In addition, in FIG. 1, a float catch is securely mounted to the anchor line, with one form of the float catch being illustrated at 40. An optional cone or other stop 41 is positioned on the anchor line above the chain 14 to prevent the slide fastener 30 from sliding onto the chain where it could become entangled.

As can be seen in FIG. 1, the anchor rope 16 passes through or engages the float catch 40 with the direction of the anchor line being altered as it passes through the float catch so that the anchor line diverges away from the float catch. Because of the divergence of the anchor line and float catch, a trap, indicated generally at 45 in FIG. 1, is provided by the float catch and line. That is, as the anchor is retrieved by powering the boat 10 to draw the anchor line through the slide fastener 30, and thus move the slide fastener relative to the anchor line toward the anchor, the slide fastener 30 eventually passes over the float catch 40 as shown in FIG. 2. When tension is relieved on the anchor line 16, the slide fastener backtracks upwardly along the anchor line and into the trap 45 with the catch 40 preventing the slide fastener 30 and float 26 from traveling further up the anchor line 16 and toward the boat. When in this position, the float 26 supports the anchor 12 close to the surface 22 while the slack anchor line 16 is retrieved. A user may grab the float, unhook it from the anchor line 16 by releasing fastener 30, and pull the anchor 12 on board the boat. Thus, the float and power provided by the boat motor do most of the work in raising the anchor from the bottom.

With reference to FIGS. 3–7, the illustrated embodiment of the float catch 40 includes an elongated body 44 having a head section 46 and a tail section 48. Although not required, most preferably the float catch 30 is of a unitary one-piece construction. Consequently, a user does not have to be concerned about the functioning of mechanically moving parts, nor does a user have to be wary of losing parts from a multi-piece float catch. Furthermore, a one-piece float catch is easy to manufacture. For example, the float catch may be mass produced from a single mold using conventional injection molding techniques, from a suitable material such as plastic. Of course, the part can be cast or otherwise manufactured from metal or another durable material. One preferred material utilized for float catches in accordance with the present invention is HOSTALLOY type 731 UHMW (ultra high molecular weight) polyethylene plastic from Hoechst Celanese of Wooddale, Ill. The cone 41 may be made of a similar material.

Figure 3:
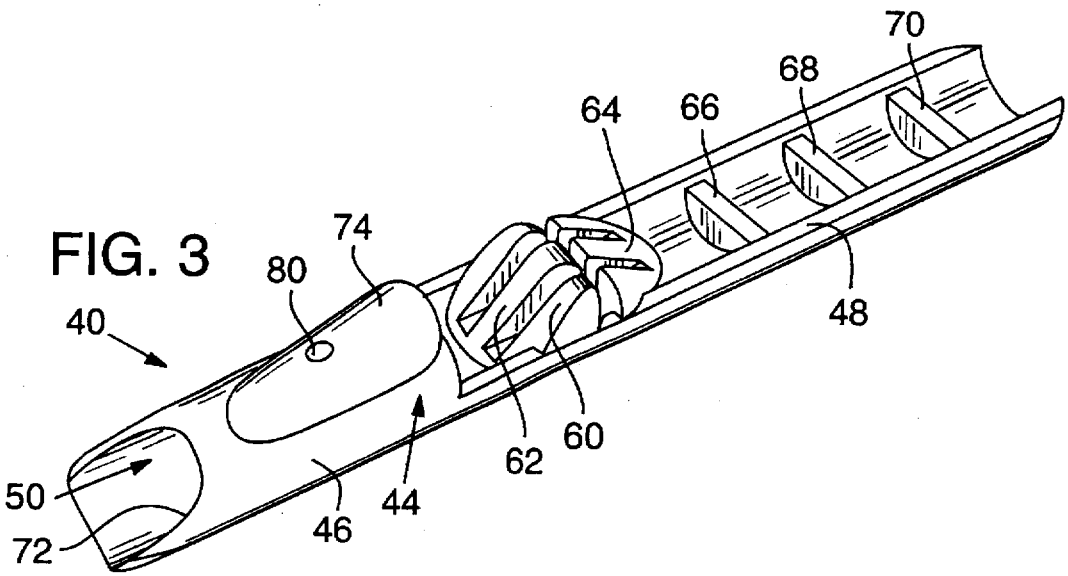
FIG. 3 is a perspective view of the float catch of FIG. 1.
Figure 4:
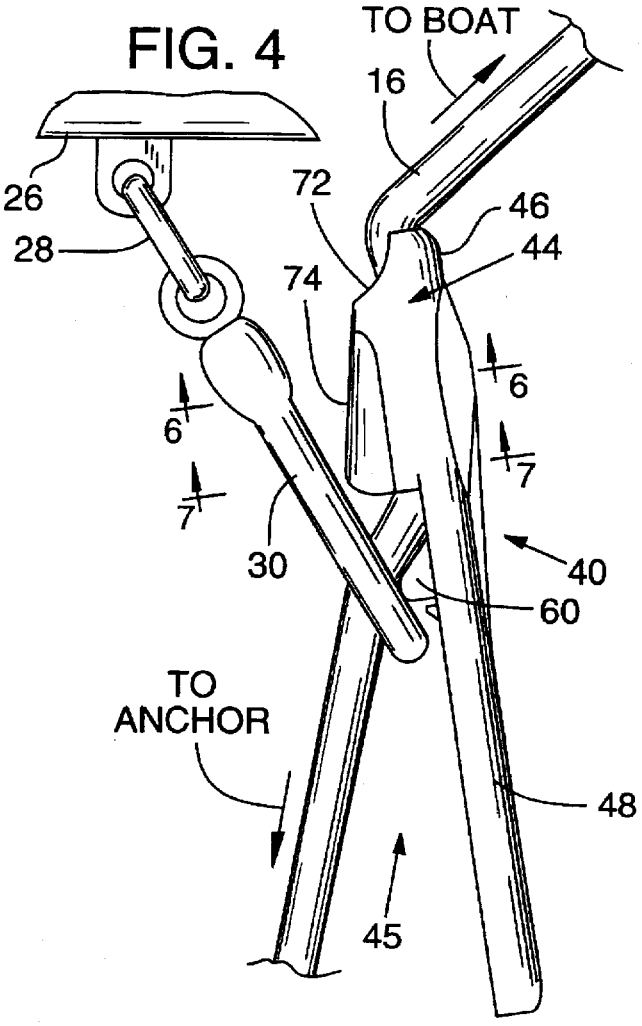
FIG. 4 is an enlarged view of the float catch of FIG. 1 shown in the position illustrated in FIG. 2.
Figure 6:
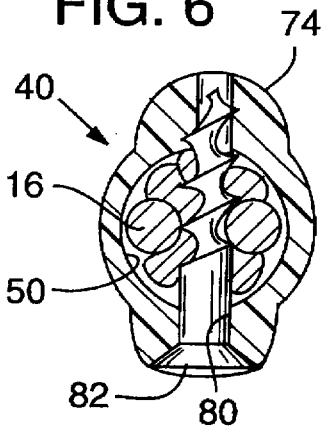
FIG. 6 is a cross-sectional view of the float catch of FIG. 4 taken along line 6—6 of FIG. 4.
Figure 7:
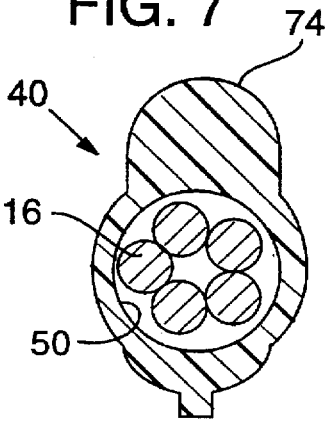
FIG. 7 is a cross-sectional view of the float catch of FIG. 4 taken along line 7—7 of FIG. 4.
Figure 5:
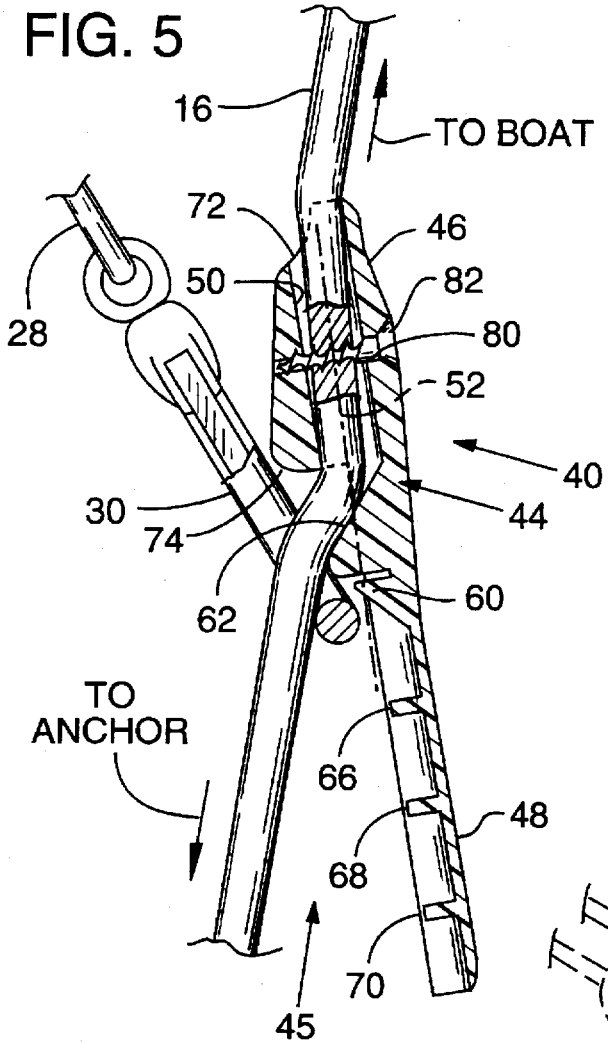
FIG. 5 is a longitudinal sectional view of the float catch of FIG. 4 taken along line 5—5 of FIG. 4.

Referring again to FIGS. 3–7, in the illustrated float catch, the head and tail section 48 have a common longitudinal axis as the body is generally straight. The head section 46 defines an anchor rope receiving passageway with the head section optionally surrounding and enclosing the passageway. The longitudinal axis of the passageway 50 is indicated by the dashed line 52 in FIG. 5. As seen in FIGS. 4 and 5, as the rope 16 extends through the passageway, it is diverted away from the tail section 48 to form the trap area 45. More specifically, as shown in these figures, the body 44 of the float catch includes a rope diverter positioned to engage the rope as it passes through the passageway and causes the rope to spread or be diverted away from the tail section. In an illustrated preferred form, the rope diverter takes the form of a ramp 60 with a rope engagement surface 62 which urges the rope to change direction from a straight line or other path through the head section and away from the tail section. Preferably, the rope engagement surface 62 is sloped and most preferably is sloped at an acute angle relative to the longitudinal axis of the rope passageway or pathway. The unnumbered slots shown in the ramp 60 in FIG. 3 are provided for molding convenience. In addition, reinforcing elements or ribs 64, 66, 68 and 70 are optionally provided to reinforce and strengthen the tail section 48.

As best seen in FIGS. 3, 4 and 5, the nose end of the head section 46 includes a tapered or concave cutout shape. Consequently, as slide fastener 30 travels relatively to the rope and toward the float catch, it more readily passes the head section 46 due to the cut-out region 72, rather than engaging and hanging up on the nose end of the head section. Also, this facilitates the use of rope of different diameters (typically one-quarter, one-half or three-quarter inches) as even with the smaller diameter ropes, the nose end of the float catch is shaped to guide the slide fastener over the float catch during anchor retrieval.

The head section 46 also includes a ramp portion 74 which projects in the same direction from the head section as does the ramp diverter 60. Ramp portion 74 is elongated and extends longitudinally along the catch body. Ramp portion 74 projects in said direction to a lesser extent at a location adjacent to the head end of the catch than at a location adjacent to the tail end of the catch. Ramp portion 74 provides an elongated exterior surface which tapers toward a head end of the body. Consequently, as the slide fastener 30 slides relative to the rope and toward the anchor, the ramp 74 assists in guiding the slide fastener past the diverter 60. This reduces the possibility of the slide fastener 30 hanging up in the space between the head section and the diverter.

The float catch 40 is typically secured at a fixed position to the anchor line 16. In the illustrated embodiment, an opening 80 extends transversely to the longitudinal axis 52 and through the head section. A threaded screw or other mechanical fastener 82 passes through opening 80 and the anchor line 16 to hold the float catch in place on the line. In FIG. 5, the fastener 82 is shown as a countersunk screw. In this case, the exposed outer surface of the screw is flush with the surface of the float catch, to prevent the screw from interfering with the passage of the slide coupler 30 past the float catch as the anchor is being retrieved. Other mechanical fasteners may, of course, be used. It is also possible to place one or more knots in the rope to retain the float catch in position, although this can weaken the rope and knots can interfere with the use of the rope for other applications.

Figure 8:
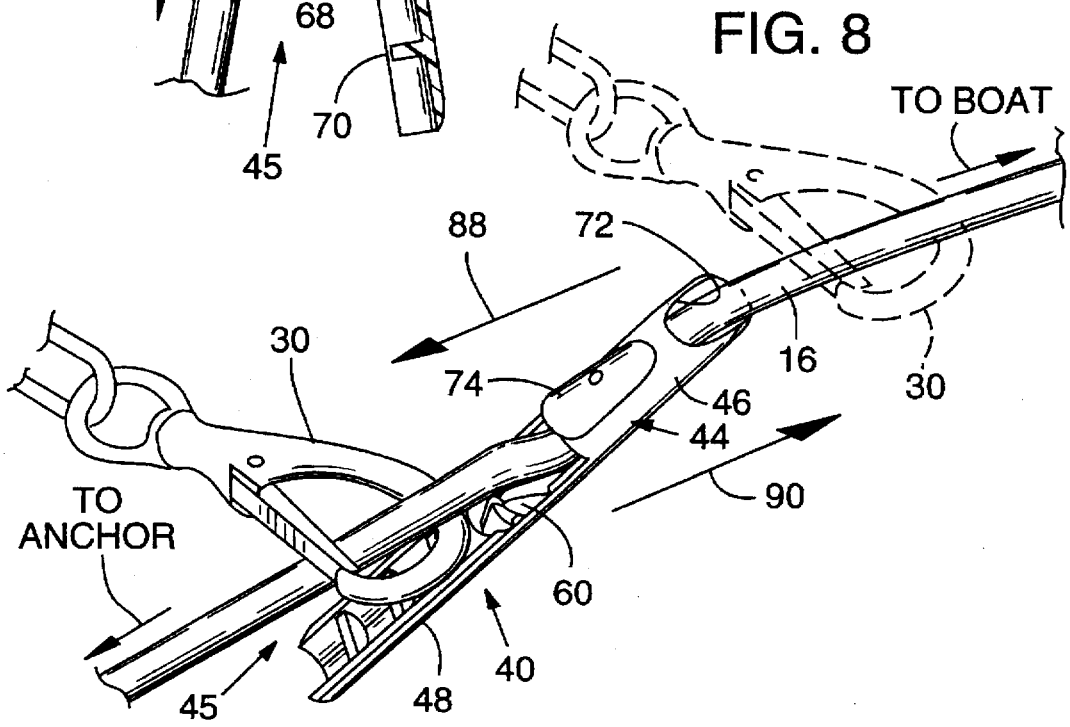
FIG. 8 is a perspective view of the float catch of FIG. 3 mounted to an anchor line and illustrating the one-way travel of a float fastener over the float catch.

Referring to FIG. 8, as the anchor is retrieved, the slide coupler 30 slides relative to the anchor line 16 in the direction of arrow 88. For practice, the float remains relatively stationary and the line 16 is pulled through the slide fastener. The slide coupler thus, in effect, moves toward the anchor and past the float catch 40. When movement of the boat stops, the anchor hangs down and the float coupler 30 slides upwardly along the anchor line 16 in the direction indicated by arrow 90. However, the coupler 30 enters the trap space 45 between the anchor line 16 and the tail section 48 of a float catch. This traps the coupler 30 and prevents it from moving up the anchor line past the float catch. When in this position, the anchor is suspended by the float as shown in FIG. 2 until the float is decoupled from the anchor line by opening fastener 30.

Figure 9:
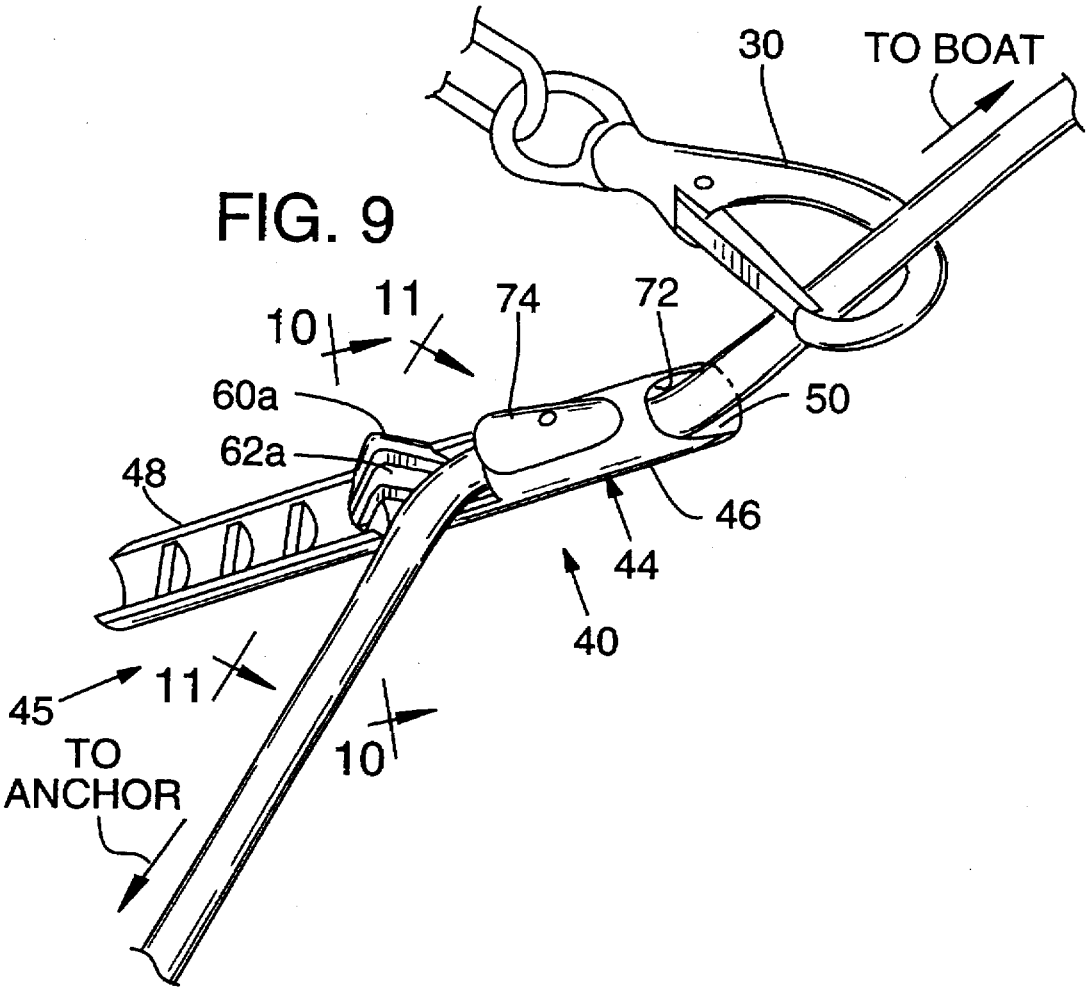
FIG. 9 is a perspective view of an alternative embodiment of the present invention with the view being similar to that shown in FIG. 8.
Figure 10:
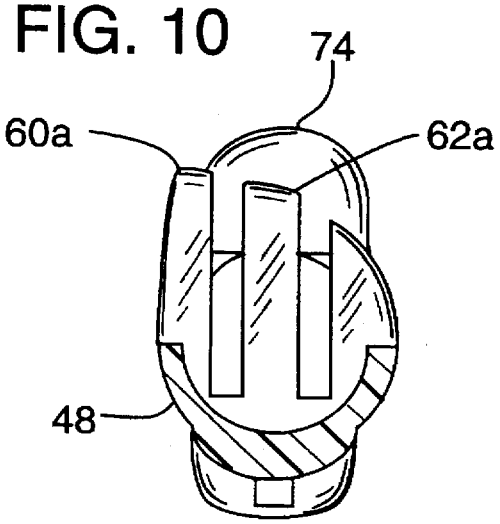
FIG. 10 is a perspective view of the float catch of FIG. 9 taken along line 10—10 of FIG. 9.
Figure 11:
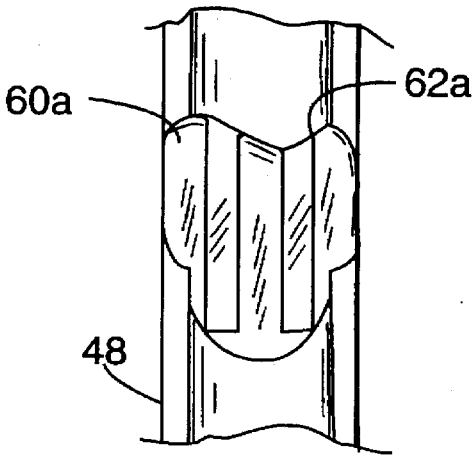
FIG. 11 is a perspective view of the float catch of FIG. 9 taken along lines 11—11 of FIG. 9.

The FIG. 9 form of the invention is similar to the FIG. 8 form of the invention and thus like numbers are for like elements. However, FIG. 9 differs from FIG. 8 in that the ramp engagement surface **62*a* of ramp 60*a* is not only sloped at an acute angle relative to the longitudinal axis of the head section 46, but is also sloped in a plane transverse to the longitudinal axis as indicated in FIG. 9. This angling of the diverter ramp is also shown in the cross-sectional view of FIGS. 10 and 11. Consequently, the rope is diverted away from the tail section of the float catch and also out of a plane passing through the diverted rope and the longitudinal axis of the float catch. This further reduces the possibility of the slide coupler 30** sliding up the rope after the anchor has been retrieved to the surface and the boat is no longer being driven.

Having illustrated and described and the principles of my invention with reference to several preferred embodiments, it should be apparent to those of ordinary skill in the art that this invention may be modified in arrangement and detail without departing from such principles. I claim as my invention all such modifications as fall within the scope of the following claims and equivalents thereto.

I claim:

1. A float catch for a boat anchoring and anchor retrieval system in which a deployed anchor is attached to the boat by an anchor line and in which a float is slidably coupled to the anchor line to permit the anchor line to slide relative to the float as the anchor is retrieved, the float catch comprising:

a body including a head section and a tail section, the head section defining an anchor rope passageway, and the body including a rope diverter positioned external to the anchor rope passageway and to engage an anchor rope passing through the anchor rope passageway, the rope diverter being shaped so as to divert the engaged rope in a direction away from the tail section, whereby as the anchor is retrieved the rope and float catch slide relative to the float in one direction until the float is positioned between the float catch and the anchor, the tail section of the float catch thereafter preventing relative travel of the float past the float catch in the opposite direction during retrieval of the anchor.

2. A float catch according to claim 1 in which the body is of a unitary one-piece molded construction.

3. A float catch according to claim 2 in which the head section surrounds the passageway.

4. A float catch according to claim 1 in which the passageway has a longitudinal axis, the rope diverter being positioned between the head section and the tail section and projecting into the path of an extension of the longitudinal axis toward the rope diverter.

5. A float catch according to claim 4 in which the rope diverter includes a rope engagement surface which is at an acute angle relative to the longitudinal axis.

6. A float catch according to claim 4 in which the rope diverter includes a rope engagement surface which is sloped in a transverse direction relative to the longitudinal axis so as to divert the rope away from the tail section.

7. A float catch according to claim 1 in which the head section includes an opening through which a mechanical rope fastener is received to secure the float catch to the rope.

8. A float catch according to claim 1 in which the anchor rope passageway is oriented to direct the rope through the head section along a rope pathway, the rope diverter comprising a diverter ramp projecting into the rope pathway.

9. A float catch according to claim 8 in which the head section includes an external ramp portion projecting in the same direction as the diverter ramp.

10. A float catch according to claim 1 in which the head section includes a tapered nose portion with a concave cutout.

11. A float catch for a boat anchoring and anchor retrieval system in which a deployed anchor is attached to the boat by an anchor line and in which a float is slidably coupled to the anchor line to permit the anchor line to slide relative to the float as the anchor is retrieved, the float catch comprising:

a generally straight body of a unitary one-piece construction having a longitudinal axis and including a head section and a tail section, the head section defining and surrounding an anchor rope passageway, the anchor rope passageway having a longitudinal axis corresponding to the longitudinal axis of the body, the body including a rope diverter positioned between the head section and the tail section, the rope diverter including a rope engagement surface which is at an acute angle relative to the longitudinal axis, the rope diverter being operable to engage the rope along the rope engagement surface and to divert the engaged rope in a direction away from the tail section;

whereby as the anchor is retrieved the rope and float catch slide relative to the float in one direction until the float is positioned between the float catch and the anchor, the tail section of the float catch thereafter preventing relative travel of the float past the float catch in the opposite direction during retrieval of the anchor.

12. A float catch according to claim 11 in which the anchor rope passageway is oriented to direct the rope through the head section along a rope pathway, the rope diverter comprising a diverter ramp projecting into the rope pathway, the head section including a tapered nose portion, and in which the head section includes an external ramp portion projecting in the same direction from the body as the diverter ramp.

13. A float catch according to claim 12 in which the head section includes an opening through which a mechanical rope fastener is received to secure the float catch to the rope.

14. A boat anchoring and anchor retrieval system comprising:

an anchor;

an anchor line coupling the anchor to the boat;

a float;

a slide fastener which slidably couples the float to the anchor line so as to permit relative movement of the line through the slide fastener and thereby relative to the float as the anchor line and anchor is retrieved;

a float catch comprising:

a body including a head section with a head end and a tail section, the head section defining an anchor rope passageway, and the body including a rope diverter positioned to engage an anchor rope passing through the anchor rope passageway, the rope diverter being shaped so as to divert the engaged rope in a direction away from the tail section, the body also including an external ramp projecting from the body and tapering toward the head end of the body whereby as the anchor is retrieved the rope and float catch slide relative to the float in one direction until the float is positioned between the float catch and the anchor, the tail section of the float catch thereafter preventing relative travel of the float past the float catch in the opposite direction during retrieval of the anchor; and wherein the anchor rope passageway is oriented to direct the rope through the head section along a rope pathway, the diverter comprising a diverter ramp projecting into the rope pathway; and wherein the anchor rope passageway has an entrance opening at the head end of the body and an exit opening, the exit opening being spaced toward the head end of the body from the diverter.

15. A boat anchoring and anchor retrieval system according to claim 14 in which the head section includes a tapered nose portion with a concave cutout.

16. A float catch comprising:

an elongated generally straight body including a head section with a head end and a tail section, the head end of the head section tapering in a direction away from the tail section and defining an anchor rope receiving passageway, the body including a diverter ramp between the head section and tail section and projecting outwardly in a first direction and into a straight-line extension of the passageway from the head section and toward the tail section, and the diverter ramp having a ramp engagement surface which slopes upwardly moving from the head section toward the tail section of the body.

17. A float catch according to claim 16 in which the head section includes a tapered nose portion and an elongated ramp portion which projects from the head section in the first direction and which tapers toward the head end of the body.

* * * * *

UNITED STATES PATENT AND TRADEMARK OFFICE

CERTIFICATE OF CORRECTION

PATENT NO. : 5,666,899
DATED : March 18, 1999
INVENTOR(S) : Rick E. Anderson

It is certified that error appears in the above-identified patent and that said Letters Patent is hereby corrected as shown below:

Column 1, line 37, "rope .and" should read --rope and--.

Column 4, line 62, "travels relatively" should read --travels relative--.

Column 5, line 35, "For practice," should read --In practice,--.

Column 5, line 50, "are for" should read --are utilized for--.

Column 5, line 64, "described and the" should read --described the--.

Signed and Sealed this

First Day of May, 2001

*Attest:*

Nicholas P. Godici

NICHOLAS P. GODICI

*Attesting Officer*

*Acting Director of the United States Patent and Trademark Office*